US011393651B2

(12) United States Patent
Neyens et al.

(10) Patent No.: US 11,393,651 B2
(45) Date of Patent: Jul. 19, 2022

(54) FUSE WITH STONE SAND MATRIX REINFORCEMENT

(71) Applicant: EATON INTELLIGENT POWER LIMITED, Dublin (IE)

(72) Inventors: Tyler Neyens, St. Louis, MO (US); Patrick Alexander von zur Muehlen, Wildwood, MO (US); David Cunningham, St. Peters, MO (US); Michael Henricks, Ellisville, MO (US); Luis Hernandez, El Paso, TX (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/986,896

(22) Filed: May 23, 2018

(65) Prior Publication Data

US 2019/0362925 A1 Nov. 28, 2019

(51) Int. Cl.

| | |
|---|---|
| ***H01H 85/38*** | (2006.01) |
| ***H01H 85/00*** | (2006.01) |
| ***H01H 69/02*** | (2006.01) |
| ***H01H 85/47*** | (2006.01) |
| *H01H 85/042* | (2006.01) |

(52) U.S. Cl.

CPC ..... *H01H 85/38* (2013.01); *H01H 69/02* (2013.01); *H01H 85/0017* (2013.01); *H01H 85/47* (2013.01); *H01H 85/042* (2013.01); *H01H 2085/383* (2013.01); *H01H 2085/388* (2013.01)

(58) Field of Classification Search

CPC .... H01H 85/38; H01H 69/02; H01H 85/0017; H01H 85/47; H01H 85/042; H01H 2085/383; H01H 2085/388

USPC ..... 337/187

See application file for complete search history.

(56) References Cited

U.S. PATENT DOCUMENTS 1,511,838 A * 10/1924 Ogle ..... H01H 85/044 337/182
1,927,905 A * 9/1933 Slepian ..... H01H 85/042 337/159
3,447,240 A * 6/1969 McClure, Jr. ..... H01H 69/02 29/424
3,755,769 A * 8/1973 Mikulecky ..... H01H 85/38 337/158
3,801,945 A * 4/1974 Howard ..... H01H 85/08 337/159
3,813,627 A * 5/1974 Koch ..... H01H 85/38 337/159
3,825,870 A * 7/1974 Ono ..... H01H 85/055 29/623
3,959,875 A * 6/1976 Salzer ..... H01H 69/02 29/623
3,983,524 A * 9/1976 Koch ..... H01H 85/042 337/159
4,028,655 A * 6/1977 Koch ..... H01H 85/042 337/160

(Continued)

*Primary Examiner* — Anatoly Vortman

(74) *Attorney, Agent, or Firm* — Baker Botts L.L.P.

(57) ABSTRACT

An electrical fuse includes a housing, first and second terminal assemblies coupled to the housing, and at least one fuse element assembly extending internally in the housing and coupled between the first and second terminal assemblies. A filler surrounds the at least one fuse element assembly, and the filler includes sodium silicate sand and at least one reinforcing structure suspended within the filler.

15 Claims, 8 Drawing Sheets

(56) References Cited

U.S. PATENT DOCUMENTS 4,034,328 A * 7/1977 Salzer ..... H01H 85/185 337/159
4,057,774 A * 11/1977 Arikawa ..... H01H 85/08 337/164
4,109,228 A * 8/1978 Wycklendt ..... H01H 85/18 337/276
4,161,714 A * 7/1979 Jacobs, Jr. ..... H01H 85/153 337/251
4,183,004 A * 1/1980 Kozacka ..... H01H 85/185 337/158
4,219,795 A 8/1980 Panaro et al.
4,237,440 A * 12/1980 Miyasaka ..... H01H 85/055 337/227
4,297,666 A * 10/1981 Asdollahi ..... H01H 85/08 337/163
4,409,729 A * 10/1983 Shah ..... H01H 69/02 29/623
4,517,544 A * 5/1985 Spaunhorst ..... H01H 85/055 337/164
4,560,971 A * 12/1985 Oh ..... H01H 85/055 337/164
4,626,817 A * 12/1986 Cameron ..... H01H 85/18 337/158
4,680,567 A * 7/1987 Edwards ..... H01H 85/12 337/164
4,736,180 A * 4/1988 Oh ..... H01H 85/055 337/163
4,972,169 A * 11/1990 Kalra ..... H01H 85/055 337/158
5,142,262 A * 8/1992 Onken ..... H01H 85/0411 29/623
5,239,291 A * 8/1993 Henricks ..... H01H 85/055 337/162
5,270,679 A * 12/1993 Gulbrandsen ..... H01H 85/18 29/623
5,406,245 A * 4/1995 Smith ..... H01H 33/76 218/150
5,426,411 A 6/1995 Pimpis et al.
5,736,919 A * 4/1998 Reeder ..... H01H 85/185 337/206
5,898,358 A * 4/1999 Tompkins ..... H01H 85/185 337/163
5,903,208 A * 5/1999 Sorger ..... H01H 85/38 337/158
5,927,060 A * 7/1999 Watson ..... D02G 3/12 337/163
6,515,570 B2 * 2/2003 Kaltenborn ..... H01H 85/06 102/275.6
6,552,646 B1 * 4/2003 Wong ..... H01H 85/143 337/231
6,650,223 B1 * 11/2003 Jollenbeck ..... H01H 85/0411 29/623
6,798,330 B2 * 9/2004 Arikawa ..... H01H 85/0418 337/187
9,443,688 B2 * 9/2016 Whitney ..... H01H 37/761
2002/0171532 A1 * 11/2002 Ackermann ..... H01H 85/0056 337/290
2007/0236323 A1 * 10/2007 Schmidt ..... H01H 85/055 337/297
2015/0348731 A1 * 12/2015 Douglass ..... H01H 69/02 337/198

* cited by examiner

FUSE WITH STONE SAND MATRIX REINFORCEMENT

BACKGROUND OF THE INVENTION

The field of the invention relates generally to electrical circuit protection fuses and methods of manufacture, and more specifically to the manufacture of high voltage, electrical fuses with a reinforced sand matrix.

Fuses are widely used as overcurrent protection devices to prevent costly damage to electrical circuits. Fuse terminals typically form an electrical connection between an electrical power source or power supply and an electrical component or a combination of components arranged in an electrical circuit. One or more fusible links or elements, or a fuse element assembly, is connected between the fuse terminals, so that when electrical current flow through the fuse exceeds a predetermined limit, the fusible elements melt and opens one or more circuits through the fuse to prevent electrical component damage. Surrounding the fuse element assembly is an arc extinguishing filler such as quartz silica sand.

Electrical fuses are operable in electrical power systems to safely interrupt both relatively high fault currents and relatively low fault currents with equal effectiveness and high durability. In certain types of fuses the durability of the electrical fuse is related to the strength of the sand filler once it has been stoned with a sodium silicate binder. In view of constantly expanding variations of electrical power systems, known fuses of this type are disadvantaged in some aspects. Improvements in electrical fuses are therefore desired to meet the needs of the marketplace.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
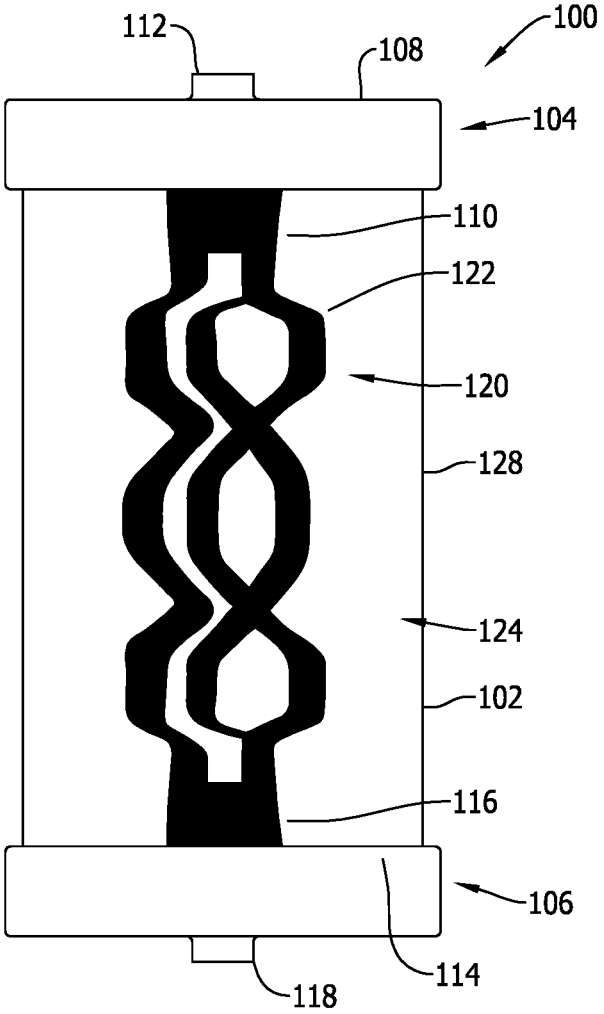
FIG. 1 is an exemplary electrical fuse.

Recent advancements in electric vehicle technologies, among other things, present unique challenges to fuse manufacturers. Electric vehicle manufacturers are seeking fusible circuit protection for electrical power distribution systems operating at voltages much higher than conventional electrical power distribution systems for vehicles, while simultaneously seeking smaller and more robust fuses to meet electric vehicle specifications and demands.

Electrical power systems for conventional, internal combustion engine-powered vehicles operate at relatively low voltages, typically at or below about 48 VDC. Electrical power systems for electric-powered vehicles, referred to herein as electric vehicles (EVs), however, operate at much higher voltages. The relatively high voltage systems (e.g., 200 VDC and above) of EVs generally enables the batteries to store more energy from a power source and provide more energy to an electric motor of the vehicle with lower losses (e.g., heat loss) than conventional batteries storing energy at 12 volts or 24 volts used with internal combustion engines, and more recent 48 volt power systems.

Electrical power systems for state of the art EVs may operate at voltages as high as 450 VDC. The increased power system voltage desirably delivers more power to the EV per battery charge. Operating conditions of electrical fuses in such high voltage power systems is much more severe, however, than lower voltage systems. Specifically, specifications relating to electrical arcing conditions as the fuse opens can be particularly difficult to meet for higher voltage power systems, especially when coupled with the industry preference for reduction in the size of electrical fuses. While known power fuses are presently available for use by EV OEMs in high voltage circuitry of state of the art EV applications, the size and weight, not to mention the durability, of conventional power fuses capable of meeting the requirements of high voltage power systems for EVs is impractically high for implementation in new EVs.

Providing relatively smaller power fuses that can capably handle high current and high battery voltages of state of the art EV power systems, while still retaining high robustness and durability as the fuse element operates at high voltages is challenging, to say the least. Fuse manufacturers and EV manufactures would each benefit from smaller, lighter, more durable fuses. While EV innovations are leading the markets desired for smaller, higher voltage fuses, the trend toward smaller, yet more powerful, electrical systems transcends the EV market. A variety of other power system applications would undoubtedly benefit from smaller fuses that otherwise offer comparable performance and superior durability to larger, conventionally fabricated fuses. Smaller, lighter, more durable high voltage power fuses are desired to meet the needs of EV manufacturers, without sacrificing circuit protection performance. Sodium silicate is applied to the sand matrix of a fuse to "stone" it to improve temperature rise performance, and interruption performance. The sodium silicate sand matrix is susceptible to damage via impact and shock forces experienced at various stages in its life cycle including; during manufacturing, handling, shipping, installation, and operation. Improvements are needed to long-standing and unfulfilled needs in the art. A reinforcement method is required to improve the robustness and durability of the stone sand matrix while meeting the temperature rise and interruption performance requirements of the fuse applications.

In addition to providing structural support for a fuse, the sodium silicate sand matrix of a fuse is designed to extinguish the arcing that occurs at the weak spots of a fuse when it heats up and melts. Damage to the sodium silicate sand matrix can result in the matrix failing to properly extinguish the arcing. This could result in damage to adjacent electrical components, and the EV itself. Additionally, damage to the sodium silicate sand matrix can result in damage to the fuse element, such that the fuse does not work as intended, resulting in the fuse heating up and melting in an undesirable location away from the center of the fuse element, or damage may result in the fuse not working at all.

Exemplary embodiments of electrical circuit protection fuses are described below that address these and other difficulties. Relative to known high voltage power fuses, the exemplary fuse embodiments advantageously offer increased durability and sturdiness during both handling and operation, while still maintaining a relatively smaller and more compact physical package size that, in turn, occupies a reduced physical volume or space in an EV 101. Also relative to known fuses, the exemplary fuse embodiments advantageously offer a relatively higher power handling capacity, higher voltage operation, full range time-current operation, lower short-circuit let-through energy performance, and longer life operation and reliability. As explained below, the exemplary fuse embodiments are designed and engineered to provide very high current limiting performance as well as long service life and high reliability from nuisance or premature fuse operation. Method aspects will be in part explicitly discussed and in part apparent from the discussion below.

While described in the context of EV applications and a particular type of fuse having certain ratings discussed below, the benefits of the invention are not necessarily limited to EV applications or to the particular fuse type or ratings described. Rather the benefits of the invention are believed to more broadly accrue to many different power system applications and can also be practiced in part or in whole to construct different types of fuses having similar or different ratings than those discussed herein.

Figure 2:
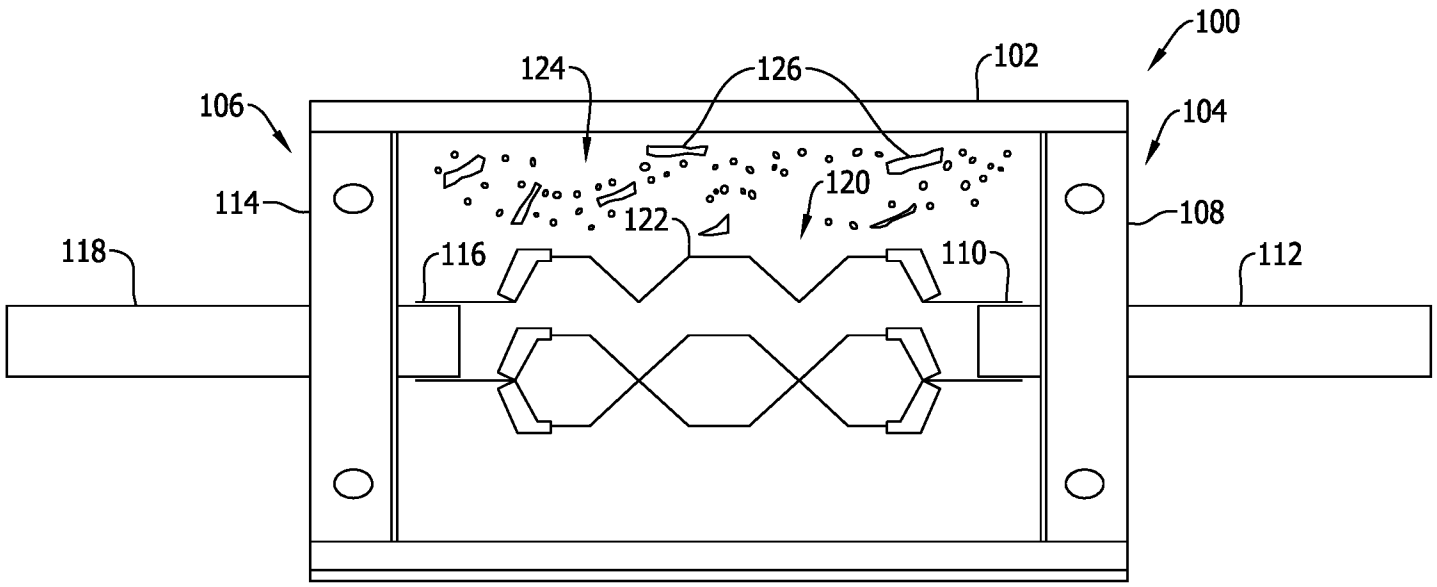
FIG. 2 is a side elevational view of an electrical fuse.

As shown in FIGS. 1 and 2, an exemplary electrical fuse 100 includes a housing 102 and terminal assemblies 104, 106. Terminal assembly 104 includes endplate 108, terminal contact block 110 and terminal blade 112. Terminal assembly 106 includes endplate 114, terminal contact block 116 and terminal blade 118. Terminal blades 112, 118 are configured for connection to line and load side circuitry. Electrical fuse 100 further includes a fuse element assembly 120 including one or more fuse elements 122 (three fuse elements in the example illustrated) that completes an electrical connection coupled between the terminal blades 112, 118. When subjected to predetermined current conditions, the fuse element melts, disintegrates, or otherwise structurally fails and opens the circuit path through the fuse element between the terminal blades 112, 118. Load side circuitry is therefore electrically isolated from the line side circuitry, via operation of the fuse element(s), to protect load side circuit components and circuitry from damage when electrical fault conditions occur.

An arc extinguishing filler medium or material 124 surrounds the fuse element assembly 120. The filler material 124 may be introduced to the housing 102 via one or more fill openings in one of the end plates 108, 114 that are sealed with fill plugs 236 (shown in FIG. 4). The fill plugs 236 may be fabricated from steel, plastic or other materials in various embodiments. In other embodiments a fill hole or fill holes may be provided in other locations, including but not limited to the housing 102 to facilitate the introduction of the filler material 124.

In one contemplated embodiment, the filling material 124 includes quartz silica sand and a sodium silicate binder. The quartz sand has a relatively high heat conduction and absorption capacity in its loose compacted state, but can be silicated to provide improved performance. For example, by adding a liquid sodium silicate solution to the sand and then drying the sand, silicate filler material 124 may be obtained with the following advantages.

The silicate material 124 creates a thermal conduction bond of sodium silicate to the fuse element assembly 120, the quartz sand, the fuse housing 102, and the end plates 108 and 114. This thermal bond allows for higher heat conduction from the fuse element assembly 120 to its surroundings, circuit interfaces and conductors. The application of sodium silicate to the quartz sand aids with the conduction of heat energy out and away from the fuse element assembly 120. The sodium silicate mechanically binds the sand to the fuse element assembly 120, terminal assemblies 104, 106 and housing 102 increasing thermal conduction between these materials. Unlike a filler material that includes sand only, the silicated sand of the filler material 124 mechanically bonds to the fuse elements as opposed to making point contact with the conductive portions of the fuse elements. Much more efficient and effective thermal conduction is therefore made possible by the silicated filler material 124. Specifically, the application of sodium silicate to the mixture of filler material 124 aids with the conduction of heat energy out and away from the fuse element weak spots and reduces mechanical stress and strain to mitigate load current cycling fatigue that may otherwise result. The sodium silicate mechanically binds the sand to the fuse element, terminal and housing increasing the thermal conduction between these materials. Less heat is generated in the weak spots and the onset of mechanical strain is accordingly retarded.

The silicated filler material 124, however, introduces certain problems in other aspects. Specifically, the silicated filler material 124 hardens like a stone and is prone to cracking. The cracking may occur for various reasons, including manufacturing imperfections, impact, and vibration of the fuse in installation, service, or use in a power system. As shown in FIG. 1, cracks 128 may form in silicated filler material 124 and may extend across the cylindrical cross section of the fuse in locations adjacent to the fuse element assembly 120. Such cracks in the stone sand matrix of the silicated filler material 124 may adversely affect the electrical performance and reliability of the fuse to operate as designed to interrupt a circuit and contain arc energy as the fuse elements open.

FIG. 2 illustrates an electrical fuse 100 including exemplary reinforcing fibers 126 to be used in combination with the silicated filler material 124 in fuse 100 and prevent the negative effects of cracking of the silicated filler material. In the exemplary embodiment, reinforcing fibers 126 are composed of inorganic (i.e., non-organic) material. In contemplated embodiments, reinforcing fibers 126 may be glass, fiberglass or other suitable materials. Additionally, reinforcing fibers 126 have varying lengths. When mixed with filler material 124, reinforcing fibers 126 are suspended within filler material 124 and are configured to increase the tensile strength of the stone sand matrix such that the durability and structural integrity of the filler material 124 in the fuse 100 is increased. In an exemplary embodiment, reinforcing fibers 126 have varying lengths and a high tensile strength. A mixture of the filler material 124 and reinforcing fibers 126 surrounds the fuse element assembly 120. The mixture of filler material 124 and reinforcing fibers 126 provides increased durability and structural support to fuse element assembly 120 and fuse 100.

Additionally, the mixture of filler material 124 and reinforcing fibers are mixed with a silica binder material to mechanically bind the mixture to the fuse element assembly 120, terminal assemblies 104, 106 and housing 102 increasing the thermal conduction and structural integrity between these materials. Because the reinforcement of the material 124 including the fibers 126, the material is more resistant to the cracking discussed above that may present performance and reliability issues of the fuse 100 in operation.

Figure 3:
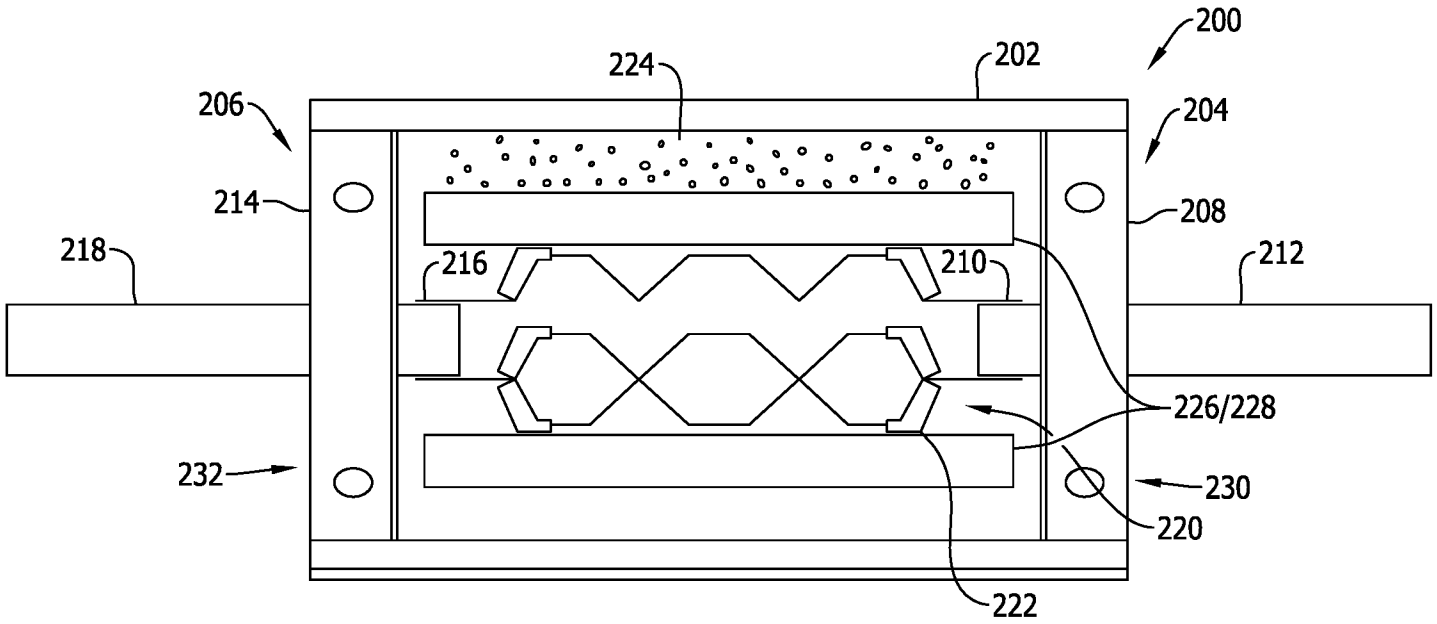
FIG. 3 is a side elevational view of an electrical fuse including a reinforcing element.

FIG. 3 illustrates an electrical fuse 200 formed in accordance with an exemplary embodiment of the present invention. As shown in FIG. 3, the electrical fuse 200 includes a housing 202, terminal assemblies 204, 206. Terminal assembly 204 includes endplate 208, terminal contact block 210 and terminal blade 212. Terminal assembly 206 includes endplate 214, terminal contact block 216 and terminal blade 218. Terminal blades 212, 218 are configured for connection to line and load side circuitry. Electrical fuse 200 further includes a fuse element assembly 220 including one or more fuse elements that completes an electrical connection coupled between the terminal blades 212, 218. The fuse element assembly 220 includes a fuse element 222. When subjected to predetermined current conditions, the fuse elements melt in the assembly, disintegrate, or otherwise structurally fail and opens the circuit path through the fuse element between the terminal blades 212, 218. Load side circuitry is therefore electrically isolated from the line side circuitry, via operation of the fuse element(s), to protect load side circuit components and circuitry from damage when electrical fault conditions occur. Additionally, housing 202 includes a first end 230, an opposing a second end 232, and an internal bore or passageway between the opposing ends 230, 232 that receives and accommodates the fuse element assembly 220.

An arc extinguishing filler medium or material 224 surrounds the fuse element assembly 220. Electrical fuse 200 further includes at least one reinforcing structure 226 suspended within the filler material 224. In the present embodiment, reinforcing structure 226 is a plurality of reinforcing rods 228. Reinforcing rods 228 are positioned on opposing sides of fuse element assembly 220, and extend along the length of the fuse element assembly 220 from adjacent terminal assembly 204 to adjacent to terminal assembly 206. Reinforcing rods 228 have a cylindrical shape and are fabricated from a non-organic (i.e., inorganic) material. In an exemplary embodiment, reinforcing rods 228 are fabricated from fiberglass or other suitable materials.

Reinforcing rods 228 provide increased structural support and added durability to the filler 224 that surrounds the fuse element assembly 220 in the fuse 200. Reinforcing rods 228 therefore protect fuse element assembly 220 from damage due to impact or vibration, and the stone sand matrix is accordingly less likely to crack. Additionally, reinforcing rods 228 protect fuse element assembly 220 by protecting it from cracks that the stone sand matrix might experience by ensuring that cracks which may form as the result of impact occur in a location away from fuse element assembly 220. This ensures that even when subject to severe impact and shock, damage to the filler 224 from cracking in the fuse 200 will be less likely to impact the operation or reliability of the fuse. When subjected to predetermined current conditions, the fuse element(s) melt, disintegrate, or otherwise structurally fail and opens the circuit path through the fuse element(s) between the terminal blades 212, 218. Load side circuitry is therefore electrically isolated from the line side circuitry, via operation of the fuse element(s), to protect load side circuit components and circuitry from damage when electrical fault conditions occur.

While exemplary terminal blades 212, 218 are shown and described for the fuse 200, other terminal structures and arrangements may likewise be utilized in further and/or alternative embodiments. For example, knife blade contacts may be provided in lieu of the terminal blades as shown, as well as ferrule terminals or end caps as those in the art would appreciate to provide various different types of termination options. The terminal blades 212, 218 may also be arranged in a spaced apart and generally parallel orientation if desired and may project from the housing 202 at different locations than those shown.

In various embodiments, the end plates 208, 214 may be formed to include the terminal blades 212, 218 or the terminal blades 212, 218 may be separately provided and attached. The end plates 208, 214 may be considered optional in some embodiments and connection between the fuse element assembly 220 and the terminal blades 212, 218 may be established in another manner.

In another exemplary embodiment, the at least one reinforcing structure 226 also includes a plurality of reinforcing fibers having a high tensile strength. The reinforcing fibers are configured to increase the strength of the stone sand matrix. Additionally, the reinforcing fibers do not include an organic material. In the exemplary embodiment, the reinforcing fibers include an inorganic material. In one embodiment, the reinforcing fibers are fabricated from glass. In another embodiment, the reinforcing fibers are fabricated from fiberglass. In the exemplary embodiment, the reinforcing fibers have varying lengths. In the exemplary embodiment, filler material 224 and the reinforcing fibers are mixed, such that the reinforcing fibers are suspended within filler material 224. A mixture of the filler material 224 and reinforcing fibers surrounds the fuse element assembly 220. The mixture of filler material 224 and reinforcing fibers provides increased durability and structural support to fuse element assembly 220 and fuse 200. The mixture of filler material 224 and reinforcing fibers are mixed with a silica binder material to mechanically bind the mixture to the fuse element assembly 220, terminal assemblies 204, 206 and housing 202 increasing the thermal conduction and structural integrity between these materials.

In another exemplary embodiment, the reinforcing structure 226 may also include a thermosetting resin. In the exemplary embodiment, the thermosetting resin does not include an organic material. The thermosetting resin is configured to form molecule chains when cured. In the exemplary embodiment the thermosetting resin is mixed with waterglass and includes melamine formaldehyde. The filler material 224 and thermosetting resin are mixed. A mixture of the filler material 224 and thermosetting resin surrounds the fuse element assembly 220. The mixture of filler material 224 and thermosetting resin provides increased durability and structural support to fuse element assembly 220 and fuse 200. The mixture of filler material 224 and thermosetting resin are mixed with a silica binder material to mechanically bind the mixture to the fuse element assembly 220, terminal assemblies 204, 206 and housing 202 increasing the thermal conduction and structural integrity between these materials.

The features described above can be used to achieve increased durability and structural integrity in fuses as demonstrated above. In other words, by implementing the features described above, whether separately or in combination, the robustness and durability of a given fuse can be increased at all points in the life cycle of the fuse.

Figure 4:
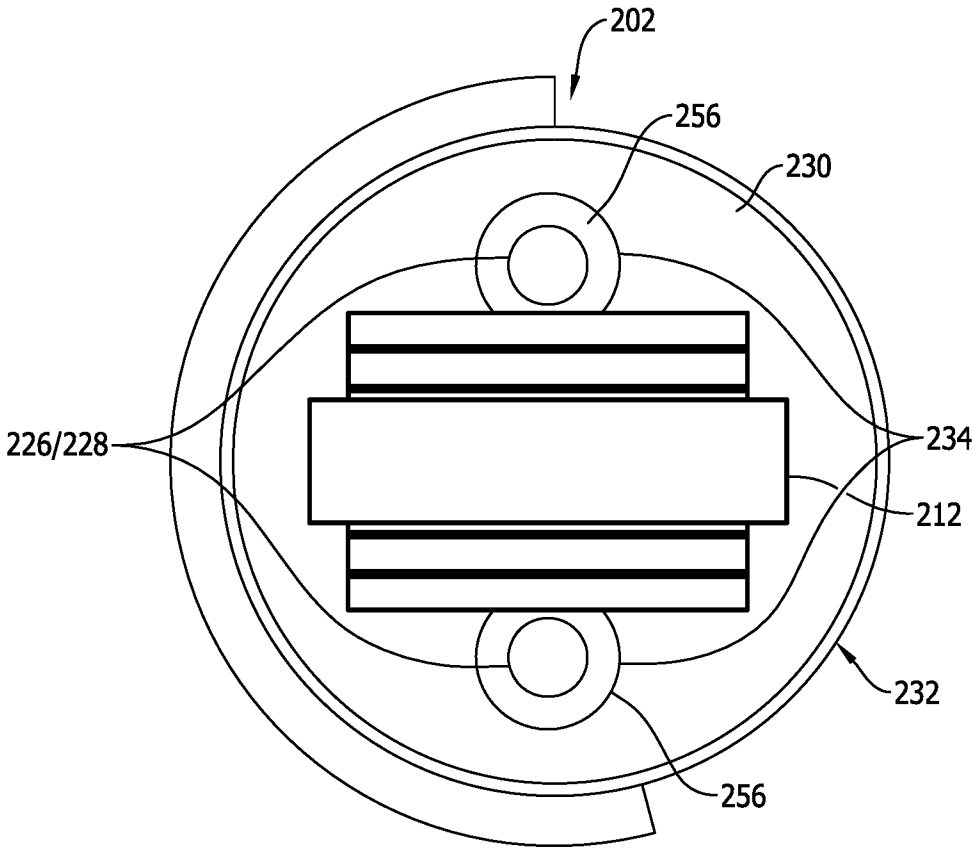
FIG. 4 is an end view with parts removed showing an internal construction of the electrical fuse shown in FIG. 3.

FIG. 4 is an end view with parts removed showing an internal construction of the electrical fuse 200, shown in FIG. 3. The housing 202 is fabricated from a non-conductive material known in the art such as glass melamine in one exemplary embodiment. Other known materials suitable for the housing 202 could alternatively be used in other embodiments as desired. Additionally, the housing 202 shown is generally cylindrical or tubular and has a generally circular cross-section along an axis perpendicular to the axial length dimensions. The housing 202 may alternatively be formed in another shape if desired, however, including but not limited to a rectangular shape having four side walls arranged orthogonally to one another, and hence having a square or rectangular-shaped cross section. The housing 202 as shown includes a first end 230, an opposing a second end 232 (shown in FIG. 3), and an internal bore or passageway between the opposing ends 230, 232 that receives and accommodates the fuse element assembly 220 (shown in FIG. 3). In some embodiments the housing 202 may be fabricated from an electrically conductive material if desired, although this would require insulating gaskets and the like to electrically isolate the terminal blades 212, 218 (Shown in FIG. 3) from the housing 202.

First and second ends 230, 232 include fill holes 234 through which filler material 224 is introduced into fuse 200. Additionally, reinforcing structures 226, such as reinforcing rods 228 are introduced into fuse 200 through fill holes 234. Fill holes 234 are used to fill fuse 200 with filler material 224, reinforcing structures 226, and silica binder material. Fill plugs 236 are used to plug fill holes 234 after fuse 200 has been filled with filler material 224. Reinforcing rods 228 and filler material 224 may be introduced into fuse 200 in any suitable order. For example, reinforcing rods 228 may be inserted into fuse 200 prior to filling fuse 200 with filler material 224, or alternatively filler material 224 may be used to fill or partially fill fuse 200 prior to reinforcing rods 228 being inserted.

Figure 5:
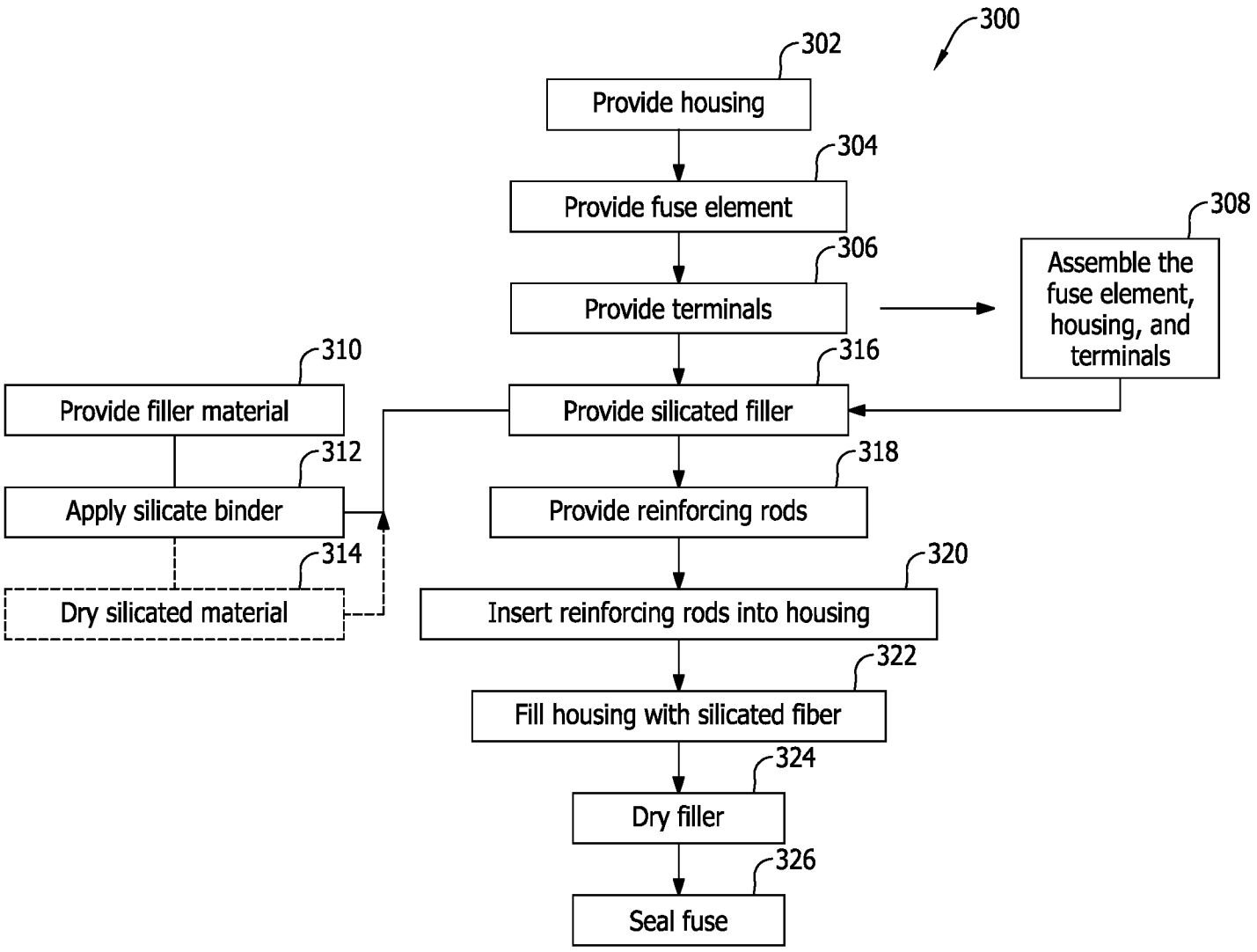
FIG. 5 is a flowchart of a first exemplary method of manufacturing the electrical fuse shown in FIGS. 2 and 3.

FIG. 5 illustrates a flowchart of an exemplary method 300 of manufacturing the electrical fuse 200 described above.

The method includes providing the housing at step 302. The housing provided may correspond to the housing 202 described above.

At step 304, at least one fuse element is provided. The at least one fuse element may include the fuse element assembly 220 described above. Other fuse element assemblies are possible, however, in alternative embodiments.

At step 306, fuse terminals are provided. The fuse terminals may correspond to the terminal blades 212, 218 described above.

At step 308, the components provided at steps 302, 304 and 306 may be assembled partially or completely as a preparatory step to the remainder of the method 300.

As further preparatory steps, a filler material is provided at step 310. The filler material may be a quartz sand material as described above. Other filler materials are known, however, and may likewise be utilized.

At step 312, a silicate binder is applied to the filler material provided at step 310. In one example, the silicate binder may be added to the filler material as a sodium silicate liquid solution. Optionally, the silicate material may be dried at step 314 to remove moisture. The dried silicate material may then be provided at step 316.

At step 318 a plurality of reinforcing rods 228 are provided. The reinforcing rods may be fabricated using fiberglass as described above. Any number of reinforcing rods may be used.

At step 320 the plurality of reinforcing rods are inserted into the housing through the fill hole(s) 234 provided in the first and second ends 230, 232 such that the reinforcing rods are on opposing sides of the fuse element assembly and extend the length of the fuse element assembly. In another embodiment, however, the reinforcing rods could be located or arranged with respect to the fuse element assembly in another manner.

At step 322, the housing may be filled with the silicate filler material provided at step 316 and loosely compacted in the housing around the fuse element assembly and reinforcing rods. Optionally, the filler is dried at step 324. The fuse is sealed at step 326 by installing fill plugs 236 to complete the assembly.

Optionally, the order of steps 320 and 322 may be switched such that silicate filler is introduced into the housing prior to the insertion of the reinforcing rods.

Using method 300, the thermal conduction bonds are established between the filler particles, the reinforcing rods 228 described above, the fuse element(s) in the housing, and any connecting terminal structure such as terminal assemblies 204, 206 described above. The silicate filler material in combination with the reinforcing rods provides an effective heat transfer system that cools the fuse elements in use, while adding tensile strength and structural support to the fuse element and fuse described above.

The mixture of filler material particles (quartz sand in this example) and the reinforcing rods 228 suspended within the filler are mechanically bonded together with the silicate binder (sodium silicate in this example), and the silicate binder further mechanically bonds the mixture of filler material particles and the reinforcing rods 228 suspended within the filler to the surfaces of the fuse element assembly. The binder further mechanically bonds the filler material particles and the reinforcing rods 228 suspended within the filler to the surfaces of terminal assemblies 204 and 206, as well as to the interior surfaces of the housing 202. Such inter-bonding of the elements is much more effective to structurally support the fuse element assembly and transfer heat than conventionally applied non-silicated filler materials that merely establish point contact when loosely compacted in the housing of a fuse. The increased tensile strength established by the combination of silicated filler particles and reinforcing rods 228 allows the fuse element assembly 220 and fuse 200 to withstand greater impact and shock forces than otherwise would be possible.

Figure 6:
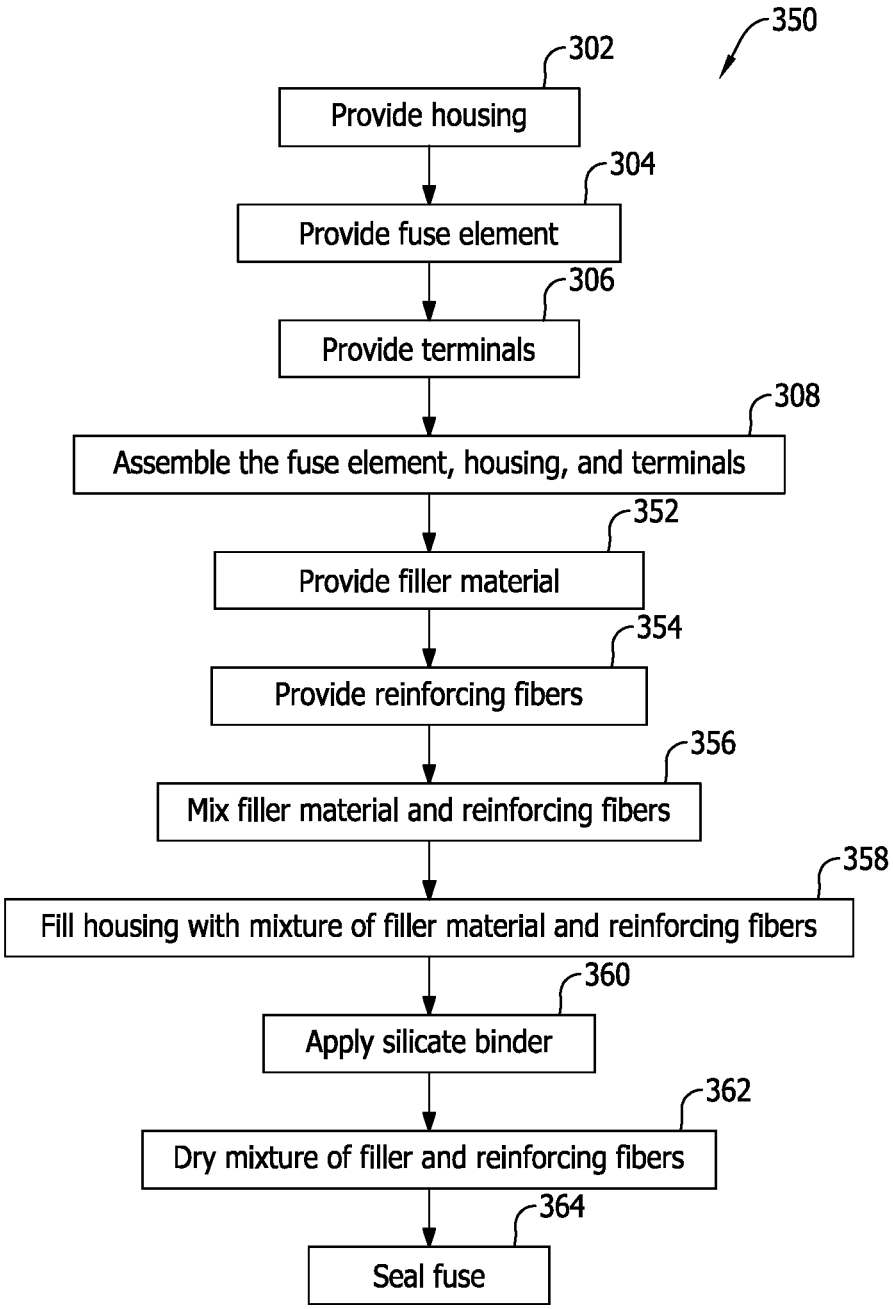
FIG. 6 is a flowchart of a second exemplary method of manufacturing the electrical fuse shown in FIG. 1.

FIG. 6 illustrates another flowchart of another exemplary method 350 of manufacturing the electrical fuse 200. The preparatory steps 302, 304, 306, 308 are the same as those described above for the method 300.

At step 352, a filler material such as quartz sand is provided.

At step 354, reinforcing fibers are provided. The reinforcing fibers may be one of glass or fiberglass as described above.

At step 356, the filler material and reinforcing fibers are mixed.

At step 358 the housing is filled with the mixture of filler material and reinforcing fibers, and the mixture is loosely packed around the fuse element(s) in the assembly of step 308.

At step 360 the silicate binder is applied. The silicate binder may be added to the filler and reinforcing fiber mixture after being placed in the housing. This may be accomplished by adding a liquid sodium silicate solution through the fill hole(s) 234 provided in the first and second ends 230, 232 as explained above. Steps 358 and 360 may be alternately repeated until the housing is full of the filler and reinforcing fiber mixture and silicate binder in the desired amount and ratios.

At step 362, the filler and reinforcing fiber mixture is dried to complete the mechanical and thermal conduction bonds. The fuse may be sealed at step 364 by installing the fill plugs 236 described above.

Using method 350, the thermal conduction bonds are established between the filler particles, the reinforcing fibers, the fuse element(s) in the housing, and any connecting terminal structure such as terminal assemblies 204, 206 described above. The silicate filler material in combination with the reinforcing fibers provides an effective heat transfer system that cools the fuse elements in use, while adding tensile strength and structural support to the fuse element and fuse described above The mixture of filler material particles (quartz sand in this example) and reinforcing fibers are mechanically bonded together with the silicate binder (sodium silicate in this example), and the silicate binder further mechanically bonds the mixture of filler material particles and reinforcing fibers to the surfaces of the fuse element assembly. The binder further mechanically bonds the mixture of filler material particles and reinforcing fibers to the surfaces of terminal assemblies 204, 206, as well as to the interior surfaces of the housing 202. Such inter-bonding of the elements is much more effective to structurally support the fuse element assembly and transfer heat than conventionally applied non-silicated filler materials that merely establish point contact when loosely compacted in the housing of a fuse. The increased tensile strength established by the combination of silicated filler particles and reinforcing fiber allows the fuse element assembly 220 and fuse 200 to withstand greater impact and shock forces than otherwise would be possible.

Figure 7:
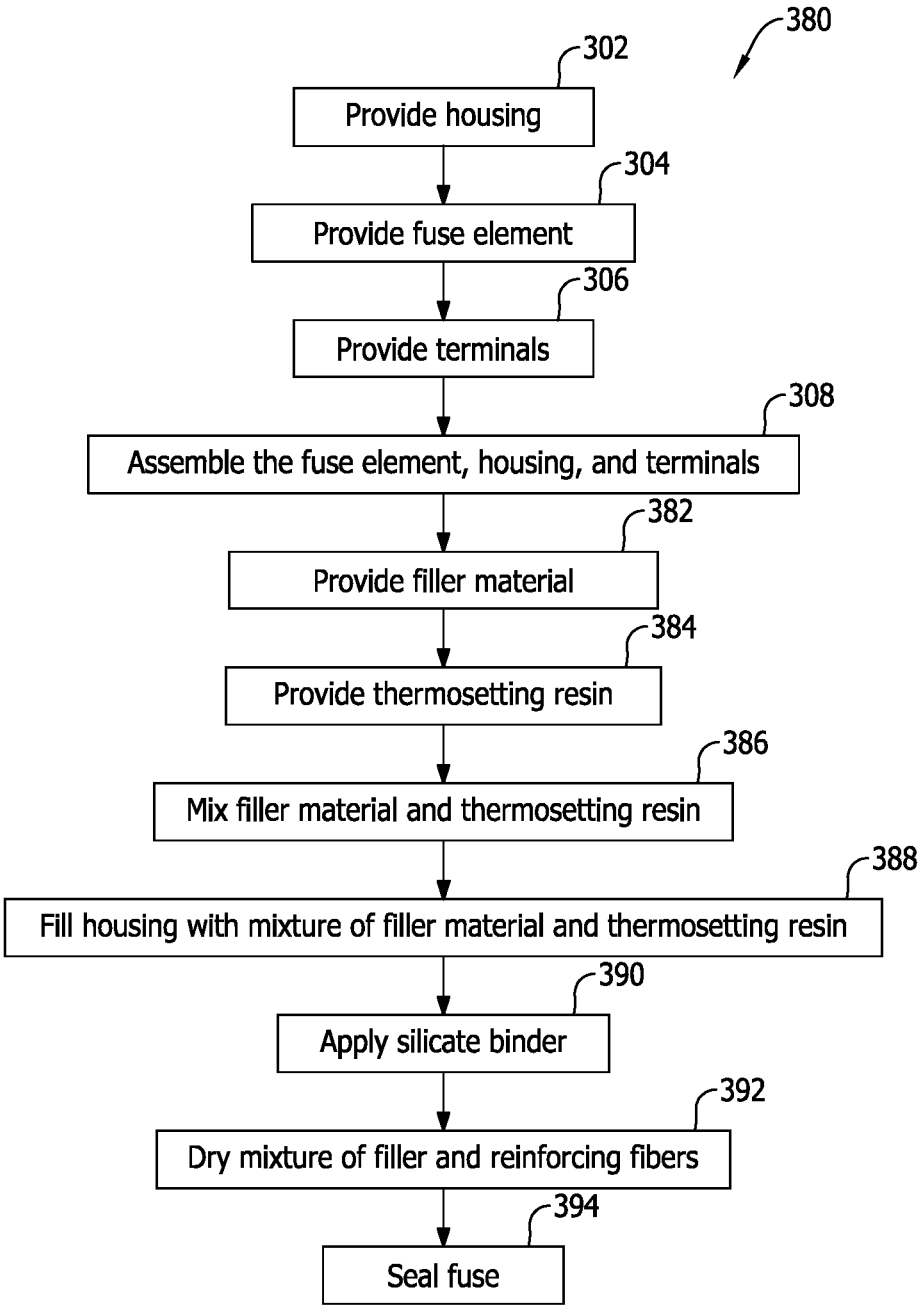
FIG. 7 is a flowchart of a third exemplary method of manufacturing the electrical fuse shown in FIG. 1.
Figure 8:
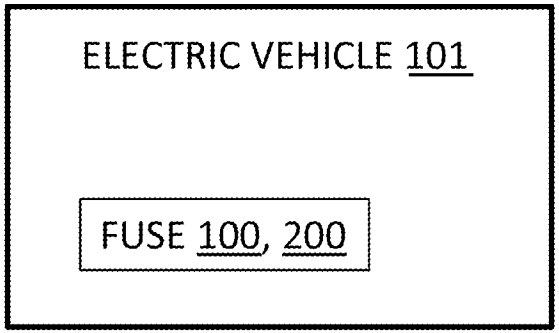
FIG. 8 is a schematic diagram of an electric vehicle.

FIG. 7 illustrates another flowchart of another exemplary method 380 of manufacturing the electrical fuse 200. The preparatory steps 302, 304, 306, 308 are the same as those described above for the method 300.

At step 382, a filler material such as quartz sand is provided.

At step 384, a thermosetting resin is provided. The thermosetting resin is configured such that when cured it forms molecule chains of melanine formaldehyde.

At step 386, the filler material and thermosetting resin are mixed.

At step 388 the housing is filled with the mixture of filler material and thermosetting resin, and the mixture is loosely packed around the fuse element(s) in the assembly of step 308.

At step 390 the silicate binder is applied. The silicate binder may be added to the filler after being placed in the housing. This may be accomplished by adding a liquid sodium silicate solution through the fill hole(s) 234 provided in the first and second ends 230, 232 as explained above. Steps 388 and 390 may be alternately repeated until the housing is full of filler and silicate binder in the desired amount and ratios.

At step 392, the mixture of filler material and thermosetting resin is dried to complete the mechanical and thermal conduction bonds. The fuse may be sealed at step 394 by installing the fill plugs 236 described above.

Using method 380, the thermal conduction bonds are established between the filler particles, the thermosetting resin, the fuse element(s) in the housing, and any connecting terminal structure such as terminal assemblies 204, 206 described above. The silicate filler material in combination with the thermosetting resin provides an effective heat transfer system that cools the fuse elements in use, while adding tensile strength and structural support to the fuse element 220 and fuse 200 described above.

The mixture of filler material particles (quartz sand in this example) and thermosetting resin are mechanically bonded together with the silicate binder (sodium silicate in this example), and the silicate binder further mechanically bonds the mixture of filler material particles and thermosetting resin to the surfaces of the fuse element assembly. The binder further mechanically bonds the mixture of filler material particles and thermosetting resin to the surfaces of terminal assemblies 204, 206, as well as to the interior surfaces of the housing 202. Such inter-bonding of the elements is much more effective to structurally support the fuse element assembly and transfer heat than conventionally applied non-silicated filler materials that merely establish point contact when loosely compacted in the housing of a fuse. The increased tensile strength established by the combination of silicated filler particles and thermosetting resin allows the fuse element assembly 220 and fuse 200 to withstand greater impact and shock forces than otherwise would be possible.

In combination with the other features described above, the reinforcement of the fuse stone sand matrix strengthens the fuse against impact and shock forces, increasing the robustness of the fuse, allowing the fuse to better perform and display improved temperature rise performance and interruption performance while still capably performing at elevated current and voltages in applications such as those described above.

The benefits of the inventive concepts disclosed are now believed to have been amply demonstrated in relation to the exemplary embodiments disclosed.

An embodiment of an electrical fuse has been disclosed including: a housing; first and second terminal assemblies coupled to the housing; at least one fuse element assembly extending internally in the housing and coupled between the first and second terminal assemblies; a filler surrounding the at least one fuse element assembly, wherein the filler includes sodium silicate sand; and at least one reinforcing structure suspended within the filler.

Optionally, the at least one reinforcing structure does not include an organic material. Optionally, the at least one reinforcing structure may be a reinforcing rod. The reinforcing rod may be fabricated from an inorganic material. Optionally, the reinforcing rod may be fabricated from fiberglass. The reinforcing rod may have a cylindrical shape. The reinforcing rod may extend along the length of the fuse element assembly from adjacent to the first terminal assembly to adjacent to the second terminal assembly. Optionally, the housing may have a cylindrical shape.

Optionally, the at least one reinforcing structure may include a plurality of reinforcing fibers having a high tensile strength suspended in the filler. Optionally, reinforcing fibers may include an inorganic material. The reinforcing fibers may be fabricated from glass. Optionally, the reinforcing fibers may be fabricated from fiberglass. The reinforcing fibers may have varying lengths. Optionally, the sodium silicate sand filler and the reinforcing fibers may be mixed and surround the fuse element assembly. Optionally the at least one reinforcing structure may include a thermosetting resin. The thermosetting resin may include an inorganic material. Optionally, the thermosetting resin may be mixed with waterglass to increase tensile strength. The thermosetting resin may include melamine formaldehyde. Optionally, the thermosetting resin may be configured to form molecule chains when cured. Optionally, a mixture of the thermosetting resin and the sodium silicate sand filler may be cured and surround the fuse element assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electrical fuse comprising:

a housing;

first and second terminal assemblies coupled to the housing;

at least one fuse element assembly extending internally in the housing and coupled between the first and second terminal assemblies;

a filler material surrounding the at least one fuse element assembly in the housing, wherein the filler material comprises sodium silicate binder and sand and hardens into a stone sand matrix; and a reinforcing element suspended entirely within the stone sand matrix, a mixture of the filler material and the reinforcing element mechanically binding directly to the housing only through the sodium silicate binder, the reinforcing element structurally supporting the stone sand matrix and increasing a tensile strength of the stone sand matrix to limit cracking of the stone sand matrix caused by at least one of manufacturing imperfections, impact, and vibration of the electrical fuse in an electric vehicle, thus limiting arcing upon opening of the fuse, and thereby to increase reliability of the electrical fuse.

2. The electrical fuse of claim 1, wherein the reinforcing element does not include an organic material.

3. The electrical fuse of claim 1, wherein the at least one fuse element assembly includes at least two fuse elements, the at least two fuse elements extending longitudinally inside the housing from the first terminal assembly to the second terminal assembly, the at least two fuse elements defining a longitudinal space between them from the first terminal assembly to the second terminal assembly, the reinforcing element is only located between the housing and the longitudinal space.

4. The electrical fuse of claim 1, wherein the reinforcing element comprises reinforcing fibers having a high tensile strength.

5. The electrical fuse of claim 4, wherein the reinforcing fibers are inorganic fibers.

6. The electrical fuse of claim 4, wherein the reinforcing fibers are glass fibers.

7. The electrical fuse of claim 6, wherein the glass fibers are fiberglass fibers.

8. The electrical fuse of claim 4, wherein the reinforcing fibers have varying lengths.

9. The electrical fuse of claim 4, wherein the reinforcing fibers are mixed with the filler material.

10. The electrical fuse of claim 1, wherein the reinforcing element comprises a thermosetting resin.

11. The electrical fuse of claim 10, wherein said thermosetting resin is an inorganic resin.

12. The electrical fuse of claim 10, wherein the thermosetting resin is mixed with waterglass to increase tensile strength.

13. The electrical fuse of claim 10, wherein the thermosetting resin comprises melamine formaldehyde.

14. The electrical fuse of claim 10, wherein the thermosetting resin forms molecule chains when cured.

15. The electrical fuse of claim 10, wherein a mixture of the thermosetting resin and the filler material is cured.

* * * * *